US006929389B1

(12) United States Patent
Rhee

(10) Patent No.: US 6,929,389 B1
(45) Date of Patent: Aug. 16, 2005

(54) LIGHTING FIXTURE FRAME AND MOUNTING PANEL APPARATUS

(75) Inventor: Shin W. Rhee, Northridge, CA (US)

(73) Assignee: Thin-Lite Corporation, Camarillo, CA (US)

( * ) Notice: Subject to any disclaimer, the term of this patent is extended or adjusted under 35 U.S.C. 154(b) by 61 days.

(21) Appl. No.: 10/631,319

(22) Filed: Jul. 31, 2003

(51) Int. Cl.[7] ..... F21V 21/00
(52) U.S. Cl. ..... 362/490; 362/147; 362/374
(58) Field of Search ..... 362/147, 223, 362/364, 365, 374, 375, 479, 488, 490, 493

(56) References Cited

U.S. PATENT DOCUMENTS

| | | | | |
|---|---|---|---|---|
| 3,239,661 | A | 3/1966 | Wince et al. | |
| 3,792,250 | A | 2/1974 | Kilbourn et al. | |
| 4,667,275 | A | 5/1987 | Herst et al. | |
| 4,698,733 | A | 10/1987 | Griffin | |
| 4,772,216 | A | 9/1988 | Szymanek | |
| D300,874 | S | 4/1989 | Syzmanek | |
| 4,827,386 | A | 5/1989 | Mackiewicz | |
| 4,891,737 | A | 1/1990 | Syzmanek | |
| D307,059 | S | 4/1990 | Syzmanek | |
| D307,059 | S | 6/1991 | Syzmanek | |
| D330,268 | S | 10/1992 | Jaksich | |
| 5,171,085 | A | 12/1992 | Jaksich | |
| 5,906,427 | A | 5/1999 | Noh | |
| 6,045,242 | A | 4/2000 | Wegrzyn et al. | |
| 6,280,052 | B1 | 8/2001 | White | |
| 6,390,654 | B1 | 5/2002 | Diaz et al. | |
| 6,491,413 | B1 * | 12/2002 | Benesohn | 362/364 |
| 6,601,976 | B1 * | 8/2003 | Rhee | 362/374 |
| 6,729,751 | B2 * | 5/2004 | Sinzawa et al. | 362/493 |

* cited by examiner

*Primary Examiner*—Y. My Quach-Lee
(74) *Attorney, Agent, or Firm*—Fulwider Patton Lee & Utecht, LLP

(57) ABSTRACT

A lighting fixture frame and mounting panel apparatus that includes a frame formed with an interior wall circumscribing a central opening and a panel for mounting a lighting device. The frame is formed with inwardly projecting stop pads and resilient legs formed with inwardly projecting teeth, and the panel is received upwardly into the central opening until it is securely mounted in a panel slot formed between the lower surfaces of the pads and the upper surfaces of the teeth.

19 Claims, 4 Drawing Sheets

FIG. 10
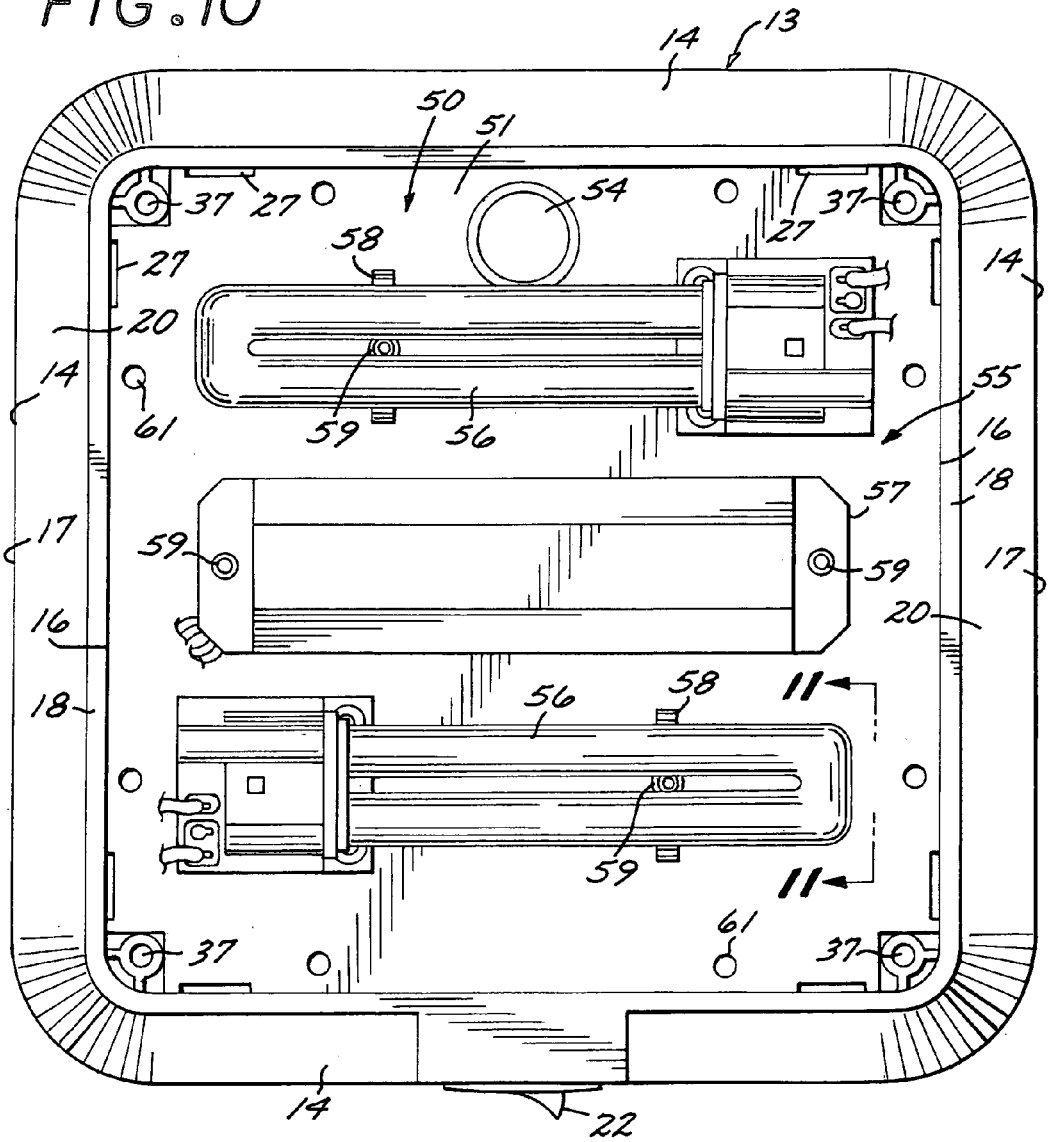
FIG. 11
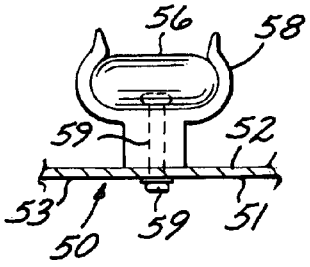
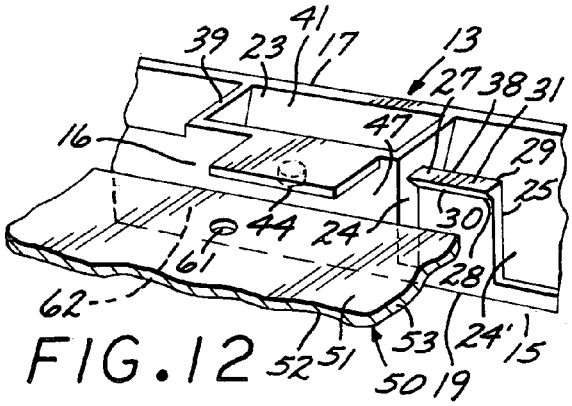
FIG. 12

LIGHTING FIXTURE FRAME AND MOUNTING PANEL APPARATUS

BACKGROUND OF THE INVENTION

1. Field of the Invention

The present invention relates to lighting fixtures, and more particularly, to lighting fixtures employed in recreational vehicles with direct current wiring.

2. Description of Related Art

Direct current, fluorescent light fixtures have become popular for use in various vehicles such as recreational vehicles, boats and long haul truck cabs. Fixtures of this type, along with many other varieties of lighting fixtures that may also be suitable for use in indoor, outdoor, commercial, industrial or residential applications, typically incorporate a frame having a border thereabout for overlying the marginal edges of an opening. Such openings are generally configured to receive a light panel that typically mounts at least one florescent light tube or any other desired illuminating means.

Cost effective assembly of such fixtures is of great importance. Given the high cost of labor, many different arrangements have been proposed to relieve labor intensive steps. One such arrangement includes a light panel received in a recessed opening defined by a frame to be loosely secured thereto during the manufacturing and assembly process for final assembly at the installation site. An arrangement of this type is shown in my U.S. Pat. No. 6,367,955, which is assigned to the assignee of the instant application and discloses a frame having laterally disposed side rails formed with inwardly projecting mounting flanges. Retainer clips situated below the frame flanges form inwardly opening notches, and a light socket mounting pan is formed with laterally outwardly turned mounting flanges configured to underlie the frame flanges to be received in the notches. The retainer clips may then be employed to loosely maintain the pan and frame in an assembled configuration during shipping and storage. Upon installation to a selected structural wall, mounting screws are inserted through both the frame flanges and the pan flanges and then driven into a selected structural wall to mount the device thereto. However, such a device, while enjoying great commercial success, requires the use of a mounting device for final assembly of the pan to the frame at the time of installation.

Thus, there exists a need for a light fixture that is conveniently pre-assembled during the manufacturing process such that its lighting device mounting panel is finally and securely mounted to its frame and such that the fixture may thereafter be readily installed on a selected structural wall or other desired mounting surface. The present invention fulfills this need.

SUMMARY OF THE INVENTION

Briefly and in general terms, the present invention is directed to a light fixture frame and mounting panel apparatus including a frame formed with a central opening that opens into a panel path for receipt of a panel mounting a lighting device. To assemble the apparatus, the panel is passed upwardly through the opening along the panel path to engage stop pads. A plurality of resiliently deflectable teeth project into such path to be engaged and deflected aside to clear the path so the panel can nest against the stop pads, allowing the teeth to snap back into position to lock the panel in place.

These and other features and advantages of the lighting fixture frame and mounting panel apparatus will become apparent from the following detailed description of preferred embodiments which, taken in conjunction with the accompanying drawings, illustrate by way of example the principles of the invention.

BRIEF DESCRIPTION OF THE DRAWINGS

FIG. 10 is a bottom view, similar to FIG. 2, but with the lens removed therefrom;

FIG. 11 is a vertical sectional view, in enlarged scale, taken from line 11—11 of FIG. 10; and FIG. 12 is an enlarged, broken perspective sectional view of the apparatus shown in FIG. 1 depicting an exemplary manner in which the mounting panel may be received in the frame.

DETAILED DESCRIPTION OF THE PREFERRED EMBODIMENTS

Figure 1:
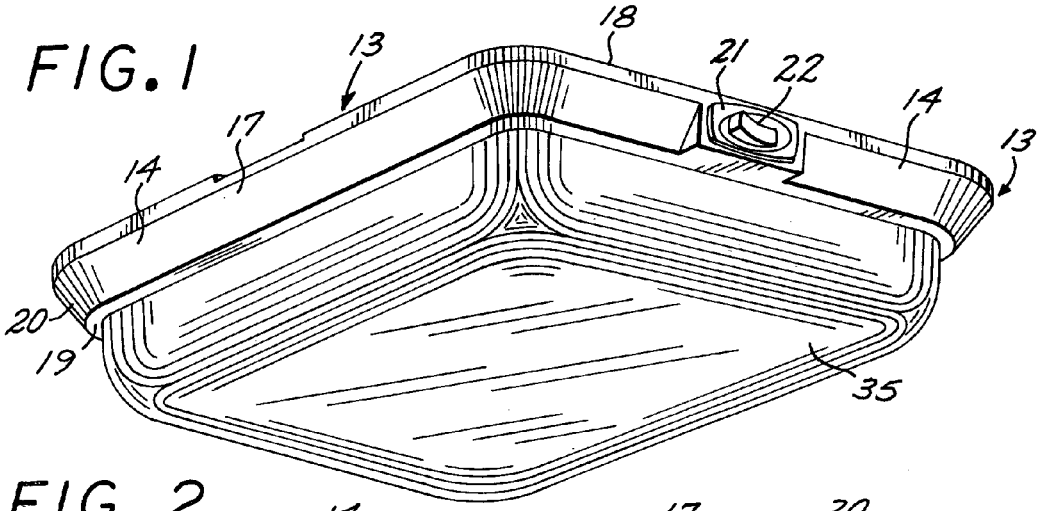
FIG. 1 is a bottom perspective view of the lighting fixture frame and mounting panel apparatus embodying the present invention.
Figure 2:
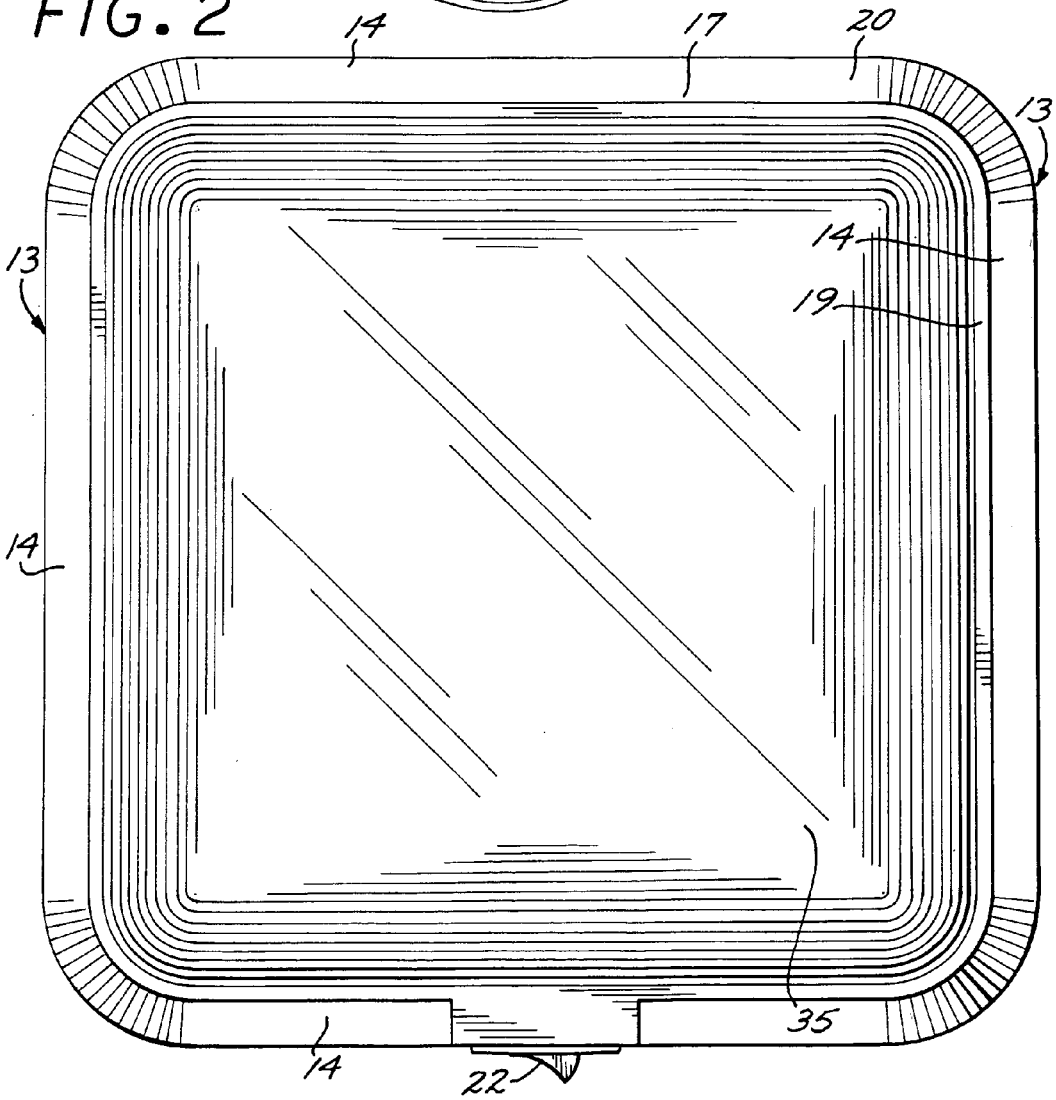
FIG. 2 is a bottom view, in enlarged scale, of the apparatus shown in FIG. 1.
Figure 3:
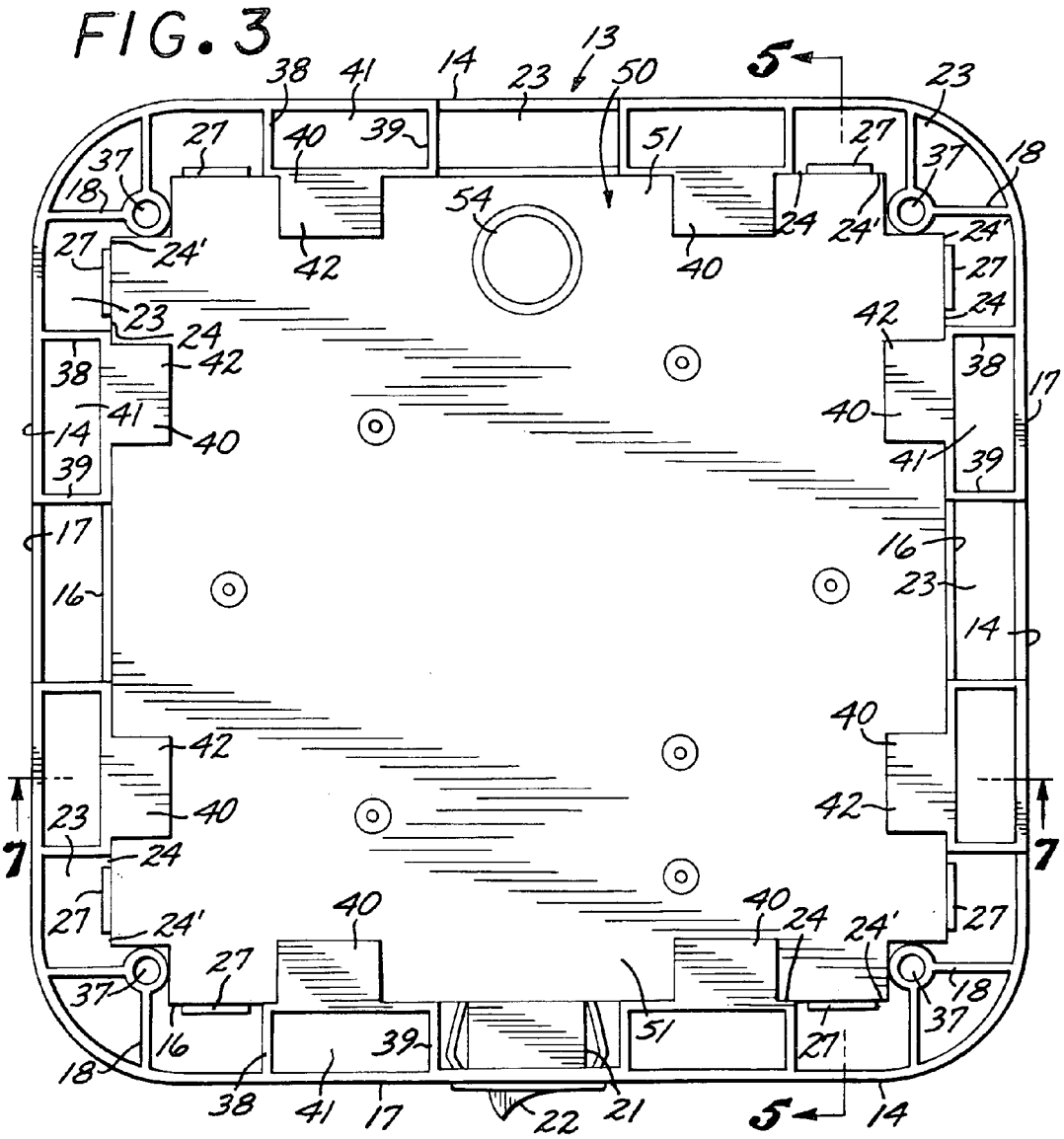
FIG. 3 is a top plan view, in enlarged scale, of the apparatus shown in FIG. 1.

Referring to FIGS. 1–5 and 10, the lighting fixture frame and mounting panel apparatus of the present invention includes, generally, a horizontal frame 13 formed with a vertical interior wall 16 circumscribing a central opening 15 leading to a vertically oriented panel path 62, and a mounting panel 50 mounting an illuminating bulb or tube which is configured for complemental receipt in the opening 15 to advance along the path 62 to an assembled position. As shown in FIGS. 3 and 12, the frame is formed at the top of the vertical wall with a plurality of stop pads 40 projecting inwardly into the path 62. The frame also includes a plurality of upstanding resilient legs 25 formed at their top ends with teeth 27 projecting horizontally into the path to lock the panel 50 against the stop pads 40. The present invention has particular utility for mounting fluorescent light tubes, and may often be used to create illumination in vehicles having D.C. electrical systems, such as recreational vehicles, motor homes, boats and the like. However, it is also contemplated that the principle features of the invention may be equally well suited for use in wide variety of commercial, industrial, recreational, indoor and even outdoor lighting applications incorporating both A.C. and D.C. electrical systems.

Figure 4:
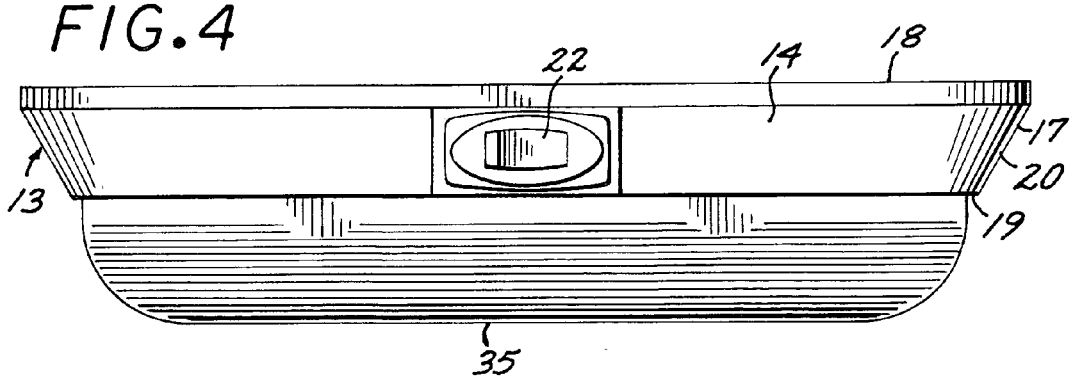
FIG. 4 is a front view, in enlarged scale, of the apparatus shown in FIG. 1.

The frame 13, as shown in FIGS. 3, 4 and 10, may be configured in any convenient or suitable shape, and in a preferred embodiment, is formed with a an interior wall 16, an exterior wall 17, an upper edge 18 and a lower edge 19. As shown in the preferred embodiment of FIGS. 5–7, the interior wall 16 is vertically oriented as it extends between the upper edge 18 of the frame 13 and the lower edge 19 to circumscribe and define the marginal edges of the central opening 15 and the panel path 62.

The frame 13 may be constructed of any convenient material, such as a durable plastic, and may include a plurality of frame segments 14. In the preferred embodiment of FIGS. 2 and 3, the frame 13 is shown as including four such frame segments 14 that cooperate to lend a generally square shape to the frame 13. As shown in the preferred embodiment of FIGS. 4–7, the exterior wall 17 angles downwardly and inwardly to form a bezel 20, and, in practice, may take on any other aesthetically pleasing or functional contour that the user may desire. Moreover, at least one of the frame segments 14 may include a switch housing 21, as depicted in FIGS. 3, 4 and 10, extending through the frame for housing a contact switch 22 connected in circuit with a selected lighting device 55 mounted on the panel. As shown in FIG. 3, the frame 13 is channel shaped to form a hollowed interior 23 to lighten the weight of the frame and reduce the material costs, and this hollowed interior may be segmented into various cavities by vertical webbing or walls.

Figure 6:
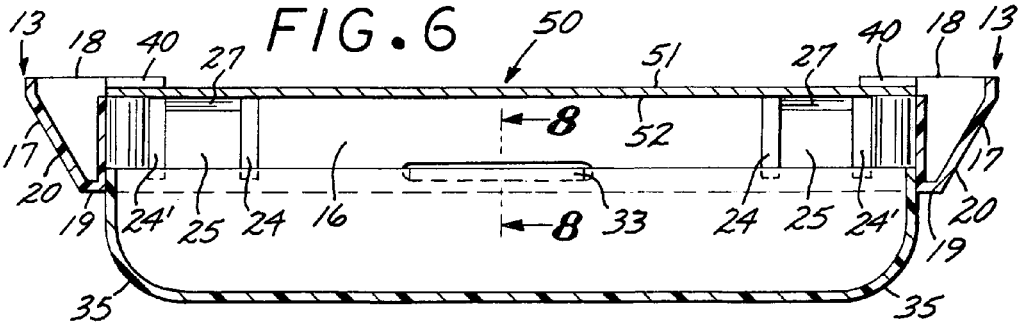
FIG. 6 is a vertical sectional view taken along line 6—6 of FIG. 5.

As shown in FIGS. 3, 6 and 12, each frame segment 14 is formed along its length with a pair of reinforcing boxes 41 defined by a pair of end walls 38 and 39 that extend transversely between the upper and lower frame edges, 18 and 19. The boxes 41 are configured on the interior sides thereof, at the upper edge 18 of the vertical wall 16, with respective inwardly projecting horizontal stop pads 40, which are respectively formed with an upper pad surface 42 and a lower pad surface 43. However, it is also contemplated that each frame segment 14 may also be formed with only a single pad 40, or various numbers of the pads 40 may be situated at suitable locations about the interior wall 16. As depicted in the preferred embodiment of FIGS. 3 and 12, the upper surfaces 42 of the pads 40 may extend inwardly from the interior wall 16 in a coplanar relationship with the upper edge 18 of the frame 13 so that the upper edge of the frame and the upper surfaces of the pads will be present an even contact surface that will rest flush against a selected wall mounting surface when the apparatus is installed thereon. So configured, the lower surfaces 43 of the pads 40 will face downwardly into the panel path 62 and will cooperate to form a first horizontal plane spaced below the upper edge 18 of the frame 13 by a distance equal to the thickness of the pads 40. The lower surfaces 43 of the pads 40 will thus act as stops to locate the panel 50 in the desired vertical location within the frame 13 and panel path 62.

Figure 7:
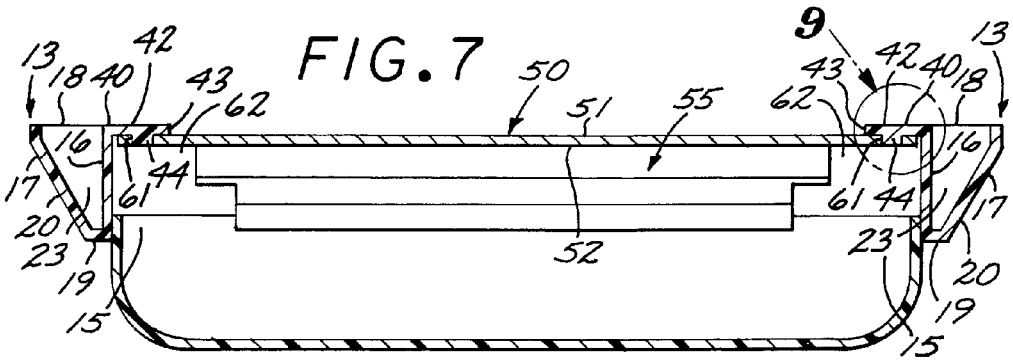
FIG. 7 is a longitudinal sectional view taken along line 7—7 of FIG. 3.
Figure 9:
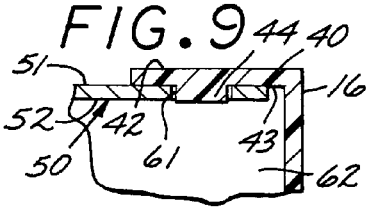
FIG. 9 is a an enlarged detail view taken from circle 9 of FIG. 7.

As shown in FIGS. 7, 9 and 12, in the preferred embodiment, registration pins 44 project downwardly from the lower pad surfaces 43 to be received in corresponding respective registration bores 61 formed along the edge of the panel 50 to assist in registering and securing the panel to the frame 13 when the top panel side 51 is abutted against the lower pad surfaces 43 and the teeth 27 are positioned to abut the bottom panel side 52 as set forth below. The bores 61 may extend completely through the panel 50, as shown in FIG. 12, or alternatively may be defined by a depression formed in the top panel side 51 that extends into the depth of the panel but terminates short of the bottom panel side 52.

With continued focus on the interior wall 16, as shown in FIGS. 3 and 12, the resilient upstanding legs 25 extend upwardly from the lower edge 19 of the frame to terminate in the respective teeth 27, which project horizontally inwardly into the panel path 62. In a preferred embodiment depicted in FIG. 3, each frame segment 14 may be formed with a pair of laterally spaced apart legs 25, with the stop pad or pads 40 being disposed therebetween. However, it is in keeping with the invention to employ any suitable combination of pads 40, legs 25 and teeth 27 dispersed about the interior wall 16 to reliably secure the panel 50 in the frame 13. To lend resiliency to the legs 25, as shown in the preferred embodiment of FIGS. 6 and 12, the interior wall 16 may be formed adjacent to the lateral edges of the respective legs 25 with respective wall openings or lightening holes 24 and 24' that extend from the upper edge 18 of the frame 13 to respective points located slightly above the lower edge 19. However, it is also contemplated that the resiliency may be achieved by a continuous interior wall 16 formed with weakened seams that define the respective lateral edges of the legs 25, or by any other suitable interior wall 16 construction.

With continued reference to FIG. 12, the teeth 27 are formed on the upper extent of each resilient leg 25 and include respective bottom surfaces 28 and top surfaces 29. The teeth 27 work in conjunction with the stop pads 40 to secure the panel 50 therebetween when it is has been advanced upwardly through the central opening 15 of the frame 13 and along the panel path 62 until the top panel side 51 is abutted against the lower surfaces 43 of the stop pads 40. To facilitate this securement, in the preferred embodiment, the bottom surfaces 28 of the teeth 27 are formed with respective cam surfaces 30, which are configured to contact corresponding portions of the marginal edges of the panel 50 as it is advanced upwardly along the path 62. Also, the top surfaces 29 of the teeth 27 are formed with respective upwardly facing support surfaces 31. These support surfaces 31 are generally planar and are collectively disposed in a second horizontal plane, which is spaced apart from and below the first horizontal plane (defined by the lower surfaces 43 of the stop pads 40) by a distance corresponding to a predetermined panel depth 53 formed between the top panel side 51 and the bottom panel side 52 to define a panel slot 47 therebetween configured for securely receiving the panel 50. While in the described preferred embodiment, the teeth 27 are formed at the upper extent of the resilient legs 25, it is also in keeping with the spirit of the invention for the teeth 27 to themselves be formed to project inwardly from the interior vertical wall 16, without associated resilient legs 25. In such an embodiment, the teeth 27 are flexible and constructed with sufficient resiliency to, upon engagement with the panel 50, flex to permit the panel 50 to be advanced past them and then return to their original configuration to be disposed below the panel 50 as described below.

Figure 5:
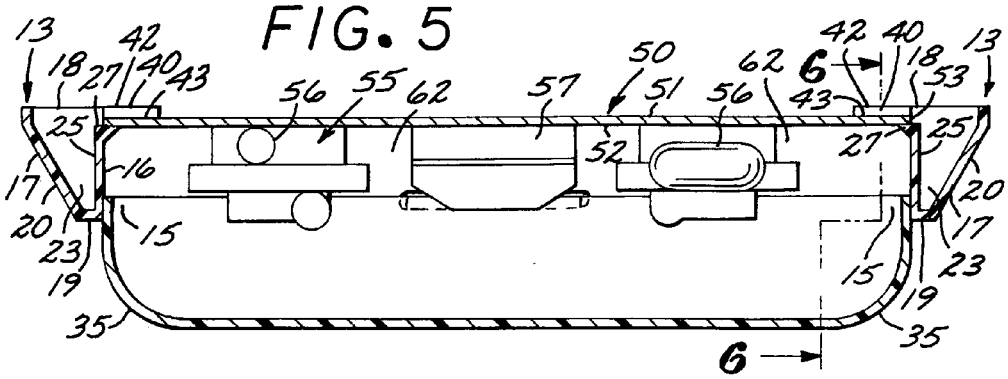
FIG. 5 is a longitudinal sectional view taken along line 5—5 of FIG. 3.

As shown in the preferred embodiment of FIG. 12 having resilient legs 25 and teeth 27, the teeth are configured such that, when the panel 50 is advanced upwardly through the central opening 15 from the lower edge 19 of the frame 13 and along the panel path 62 toward the upper edge 18 of the frame, corresponding portions of the top panel side 51 in the vicinity of its marginal edges will first engage the respective cam surfaces 30 of the teeth 27 as they project into the panel path 62. Further advancement of the panel over the cam surfaces will cause the free extremities of the resilient legs 25 to flex laterally outwardly from their resting position and then return to this original configuration when the panel 50 has advanced past the cam surfaces 30. In this returned configuration, as shown in FIGS. 3, 5 and 10, the support surfaces 31 of the teeth 27 will be abutted against corresponding portions of the bottom panel side 52 in the vicinity of its marginal edges. The panel 50 will also be prevented from further upward advancement along the path 62 as the top panel side 51 is abutted against the lower surfaces 43 of the stop pads 40, as shown in FIG. 3. In this preferred embodiment, the registration pins 44 are also positioned in the registration bores 61 concurrent with the engagement of the cam surfaces 30 with the edges of the panel 50 and with the outward flexing of the legs 25 such that, when the legs flex back into the panel path to engage the support surfaces of the teeth with the bottom panel side 52 and the top panel side 51 is abutted against the stop pads 40, the registration pins 44 will be received in the registration bores 61 to cooperate with the stop pads 40 and teeth 27 in registering and securing the panel 50 in the panel slot 47.

In a preferred embodiment as shown in FIG. 12, the cam surfaces 30 of the teeth 27 are angled upwardly and inwardly for engaging the generally transversely oriented lateral edges of the panel 50. However, it is also in keeping with the spirit of the invention for the cam surfaces 30 to take on any convenient shape for facilitating the flexing engagement of the legs 25 with the edges of the panel 50, such as for example a rounded contour. It is further contemplated that, in an alternate embodiment, the marginal edges of the panel 50, rather than the teeth 27, may be formed with the cam surfaces 30. In such an embodiment, the bottom surfaces 28 of the teeth 27 are configured for engagement with the cam surfaces of the panel 50 to cause the legs 25 to flex outwardly and then return to their original configuration as described above. In other alternative embodiments, it is contemplated that the panel 50 may be cut away along portions of its marginal edges to form horizontally outwardly projecting teeth configured for receipt in corresponding openings defined by spaced apart lips constituting stops formed in the interior vertical wall 16 at a desired mounting location along the panel path 62, or that the panel edges may be formed with horizontally outwardly projecting pins to be received in corresponding stop bores formed along the interior wall.

Referring to FIGS. 3, 10 and 11, the bottom panel side 52 of the panel 50 is adapted to mount the hardware of a pre-selected lighting device 55, which in the preferred embodiment depicted in FIGS. 10 and 11 includes a pair of fluorescent lighting tubes 56 with associated tube support platforms 58 and a wire housing 57. Depending on the manufacturing and assembly requirements, the panel 50 may be pre-assembled and formed with such a lighting device 55 affixed thereto, or the lighting device may be affixed to the panel after the panel is securely received and registered in the panel slot 47. It is contemplated that the lighting device 55 may take any of a wide variety of forms that are well known in the art, it only being important to the invention that the bottom panel side 52 be adaptable to mount such a lighting device 55 and that the device provide the requisite illumination desired by the user. As shown in the exemplary depiction of FIG. 11, the hardware of the lighting device 55 may be secured to the panel 50 by hardware connection means 59, which may take on any convenient configuration that is well known in the art for securing such lighting hardware to a mounting panel. The panel 50 may be further formed with a wire passage 54 to permit the necessary wires of the lighting device 55 to pass from the bottom panel side 52 to the top panel side 51, thereby making such wires available for connection to an external power source in the vicinity of the selected mounting surface of a wall. It is also contemplated that the top panel side 51 may be generally planar, as depicted in FIG. 3, or may be formed with selected mounting means that may cooperate with the frame 13 in mounting the apparatus to such a selected mounting surface.

Figure 8:
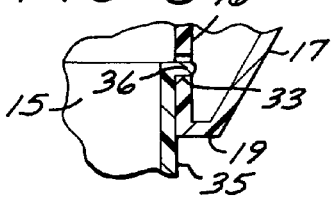
FIG. 8 is a transverse sectional view, in enlarged scale, taken along line 8—8 of FIG. 6.

To cover and protect the lighting device 55, a lens 35, as shown in FIGS. 2 and 4, is configured to be received in the frame 13. The lens may be selected to permit any desired level of light passage therethrough, and is configured on its outer perimeter with a plurality of outwardly projecting lens tabs 36 configured for complemental receipt in corresponding lens mounting slots 33 formed in the interior wall 16 of the frame 13, as depicted in FIGS. 6 and 8. In a preferred embodiment, the interior wall 16 of each frame segment 14 is formed with at least one lens mounting slot 33 for receiving a corresponding tab 36 formed to project outwardly from a lateral edge of the lens. However, it is also contemplated that each frame segment may be formed with a plurality of mounting slots 33 for receiving a corresponding number of tabs 36 formed on the lens 35, or any other suitable connection means known in the art may be employed to removably secure the lens in the frame. In a preferred embodiment, the lens 33 is formed from a material that is sufficiently resilient to hold its configuration and provide protection to the lighting device while also permitting distortion of the lens sufficient to dislodge the tabs 36 from the slots 33, thereby removing the lens 35 from the frame 13.

When the apparatus embodying the invention is attached to a selected wall mounting surface, the frame 13 is designed to be horizontally oriented, as shown in FIG. 4, with the upper edge 18 abutted against the selected wall mounting surface and the lower edge 19 vertically spaced apart from and situated below the upper edge 18. Likewise, when the panel 50 is received upwardly into the central opening 15 and advanced through the panel passage path 62, the top panel side 51 will face upwardly towards the selected wall mounting surface and the bottom panel side 52 will face downwardly into the path 62. To mount the apparatus to a selected wall mounting surface as described above, the frame 13 may be configured with any suitable mounting means known in the art, and such mounting means may also be formed on the panel top side 51 to function individually or in conjunction with the means formed on the frame to secure the frame to the selected mounting surface. In one preferred embodiment shown in FIG. 10, such mounting means includes hollowed vertical cylindrical barrels 37 formed in the frame 13 in the vicinity of the intersection of adjacent frame segments 14 and defining vertical bores for receipt of respective mounting screws or the like.

In manufacture, the panel and frame may be mass produced separately. The panel itself may be formed and the lighting electronics secured thereto by riveting or other well known fastening means. The panels and frames may then be joined in a production line. In so doing, a panel 50 may be selected from inventory to be secured to the frame 13. Such panel 50 may then be positioned upright in the central opening 15 in the vicinity of the lower edge 19 of the frame and advanced upwardly through the panel passage path 62. The marginal edges of the top panel side 51 will then engage the cam surfaces 30 of the teeth 27, and further upward travel will force the free extremities of the resilient legs 25 to be driven laterally outwardly to allow the edges of the panel 50 to clear such teeth. This will then permit the free extremities of the legs 25 to return to their normal configuration by flexing laterally inwardly, which will cause the top surfaces 29 of the legs to shift underneath the bottom panel side 52 such that the support surfaces 31 of the teeth 27 will be abutted against corresponding portions of the bottom panel side 52 in the vicinity of its marginal edges.

Further upward advancement of the panel 50 along the path 62 will be prevented as corresponding portions of the top panel side 51 encounter the stop pads 40, and the panel 50 will thereby be secured in place in the panel slot 47 with the top panel side 51 abutted against the lower surfaces 43 of the pads 40 and the bottom panel side 52 abutted against the support surfaces 31 of the teeth 27 of the resilient legs 25. If registration pins 44 are formed on the lower surfaces 43 of pads 40, concurrent with the engagement of the panel 50 with the cam surfaces 30 of the teeth 27 and the laterally inwardly flexing of the legs 25 to position the support surfaces 31 under the bottom panel side 52, the registration pins 44 will be received in the registration bores 61 of the panel 50. So configured, the shear strength of the pins 44 will resist lateral shifting of the panel 50 when adjustments are made to the lighting device 55 or lighting hardware components are added to the panel, and the pins 44 received in the bores 61 will cooperate with the teeth 27 and stop pads 40 in securely registering and holding the panel in place in the slot 47. Thus, panel 50 may be assembled with the electrical components thereon and may be quickly married with the frame 13 at the time of assembly. So configured, the panel will be held in place in the frame without the necessity of separate fasteners, and the apparatus may be packaged and shipped without disassociation and disassembly from one another.

From the foregoing, it will be appreciated that the lighting fixture frame and mounting apparatus of the present invention is economical to manufacture, convenient to assemble and will be received by the user in a configuration ready for immediate installation. While several particular forms of the invention have been illustrated and described, it will also be apparent to those skilled in the art that various modifications can be made without departing from the spirit and scope of the invention. For example, while the lighting device is preferably connected to an external power source, it is contemplated that it may also be powered by an on-board source such as battery power or the like. Moreover, the mounting means may take any form that is well known in the art, it only being important that it facilitate the secure mounting of the apparatus to a selected mounting surface. Additionally, while the frame has been described as being configured such that the panel is received upwardly into the central opening and panel passage path, it is also contemplated that the frame, along with its stop pads and resilient legs, may be configured such that the panel is received downwardly in the frame. Accordingly, it is not intended that the present invention be limited except by the following claims.

What is claimed is:

1. A lighting fixture frame and mounting panel apparatus comprising:

a fixture frame including an upper edge, a lower edge, and a vertically oriented interior wall circumscribing a central opening and a panel path;

a plurality of stop pads formed in the vicinity of the upper edge and projecting inwardly from the interior wall into the panel path, the pads being formed with respective lower surfaces that collectively define a first horizontal plane;

the interior wall including a plurality of resilient legs formed with respective teeth projecting inwardly into the panel path having respective upwardly facing support surfaces collectively configured to define a second horizontal plane spaced apart from the first horizontal plane to define a horizontal panel slot therebetween; and a fixture panel complementally contoured and dimensioned for slidable receipt through the central opening and advancement along the panel path to engage the respective teeth to deflect the teeth clear of the path and to further engage the stop pads and clear the teeth such that the teeth are urged back into the panel path and disposed below the panel.

2. The lighting fixture frame and mounting panel apparatus of claim 1 wherein:

the teeth are formed with respective bottom surfaces defining cam surfaces configured for engagement of corresponding portions of the marginal edges of the panel as it is advanced along the panel path; and the legs are configured to, upon such engagement of the panel with the teeth, flex outwardly from a normal position, and, upon continued advancement of the panel causing the cam surfaces to clear the panel, flex back to their normal position, thereby positioning the teeth under the panel and engaging the support surfaces with corresponding portions of the panel to cooperate with the stop pads in securing the panel in the panel slot.

3. The lighting fixture frame and mounting panel apparatus of claim 1 wherein:

the marginal edges of the panel are configured for engagement with corresponding portions of the teeth as the panel is advanced along the panel path; and the legs are configured to, upon such engagement of the teeth with the marginal edges of the panel, flex outwardly from a normal position, and, upon continued advancement of the panel causing the teeth to clear the marginal edges, flex back to their normal position, thereby positioning the teeth under the panel and engaging the support surfaces with corresponding portions of the panel to cooperate with the stop pads in securing the panel in the panel slot.

4. The lighting fixture frame and mounting panel apparatus of claim 1 wherein:

the stop pads are formed on their respective lower surfaces with respective downwardly projecting registration pins; and the panel is formed with respective corresponding bores for receiving the registration pins therethrough when the panel is received in the panel slot.

5. The lighting fixture frame and mounting panel apparatus of claim 1 wherein:

the panel is formed with a bottom panel side that includes a lighting device.

6. The lighting fixture frame and mounting panel apparatus of claim 5 including:

a lens configured for removable receipt in the frame for substantially occupying the central opening and covering and protecting the lighting device.

7. The lighting fixture frame and mounting panel apparatus of claim 1 wherein:

the panel is formed having a predetermined depth; and the panel slot is dimensioned to correspond to the predetermined depth.

8. The lighting fixture frame and mounting panel apparatus of claim 1 wherein:

the upper surfaces of the stop pads are coplanar with the upper edge of the frame.

9. A lighting fixture frame and mounting panel apparatus comprising:

a frame formed with a plurality of frame segments including respective vertically oriented interior walls defining therebetween a central opening and a panel passage path;

at least one stop pad projecting inwardly from the upper extremity of the interior wall of each frame segment and including a lower surface such that the collective lower surfaces of the stop pads are disposed in a first horizontal plane;

at least one resilient leg included on the interior wall of each frame segment and projecting upwardly from the lower extremity of the interior wall to terminate in a horizontally inwardly projecting tooth that includes a downwardly facing cam surface on one side and an upwardly facing support surface on the opposite side such that the collective support surfaces of the teeth are disposed in a second horizontal plane spaced a selected distance below the first horizontal plane to define a panel slot therebetween; and a panel having a bottom panel side and a top panel side and being complementally configured and contoured for slidable receipt upwardly through the central opening and advancement along the panel passage path, the panel being further formed with a thickness corresponding with the selected distance such that, when the panel is advanced past the teeth of the resilient legs and the top panel side is abutted against the lower surfaces of the stop pads, the panel may be held in place in the panel slot.

10. The lighting fixture frame and mounting panel apparatus of claim 9 wherein:

the teeth are configured such that upward advancement of the panel along the panel passage path will cause engagement of corresponding portions of the marginal edges of the top panel side with the cam surfaces of the teeth; and the legs are configured to flex outwardly from a resting state upon such engagement, and, upon continued advancement of the panel causing the cam surfaces to clear the panel, flex back to their resting state, thereby positioning the respective support surfaces of the teeth under corresponding portions of the bottom panel side in the vicinity of its marginal edges to cooperate with the stop pads in securing the panel in the panel slot.

11. The lighting fixture frame and mounting panel apparatus of claim 9 wherein:

the interior wall of each frame segment is formed with two laterally spaced apart resilient legs; and the at least one stop pad is disposed therebetween.

12. The lighting fixture frame and mounting panel apparatus of claim 9 wherein:

the interior wall of each frame segment is formed with two laterally spaced apart resilient legs and two laterally spaced apart stop pads; and the stop pads are disposed between the resilient legs.

13. The lighting fixture frame and mounting panel apparatus of claim 9 wherein:

the bottom panel side includes a lighting device.

14. The lighting fixture frame and mounting panel apparatus of claim 13 including:

a lens configured for removable receipt in the frame for substantially occupying the central opening and covering and protecting the lighting device.

15. A method of assembling a lighting fixture frame and mounting panel apparatus including:

selecting a fixture frame including a vertically oriented interior wall circumscribing a central opening and a panel passage path, a plurality of stop pads that project inwardly from the interior wall and include respective lower surfaces that collectively define a first horizontal plane, and a plurality of upwardly extending resilient legs included on the interior wall and terminating in respective inwardly projecting teeth having downwardly facing cam surfaces and upwardly facing support surfaces collectively configured to define a second horizontal plane spaced a selected distance below the first horizontal plane to define a panel slot therebetween;

selecting a fixture panel complementally contoured for receipt in the central opening and advancement along the panel passage path, the panel being configured with a top panel side and a bottom panel side and having a panel depth corresponding to the selected distance;

positioning the panel in the central opening and advancing it upwardly through the panel passage path so that the top panel side will engage the cam surfaces and the resilient legs will then be flexed outwardly from a resting position;

advancing the panel further to cause the cam surfaces to be released from their engagement with the panel such that the resilient legs will flex back to their resting position; and securing the panel in the panel slot with the top panel side engaging the lower surfaces of the pads and the bottom panel side engaging the support surfaces of the teeth.

16. The method of claim 15 including:

mounting a lighting device to the bottom panel side.

17. The method of claim 16 including:

releasably mounting a lens to the frame to substantially occupy the central opening and cover and protect the lighting device.

18. A light fixture apparatus comprising:

a frame formed with a parametric interior vertical wall forming a downwardly facing opening and an upwardly extending panel pathway;

stop means formed on an upper side of the frame and projecting horizontally into such pathway;

a light mounting panel configured to be received slidably through the opening and up into the pathway to abut the stop means; and locking means including a plurality of teeth normally exposed in a horizontal plane spaced downwardly from the stop means and normally projecting and biased into such pathway but engageable with the panel as it is shifted upwardly into such pathway as to be deflected from such pathway to allow the panel to clear such teeth and operative upon such clearance to be biased back into such pathway.

19. A direct current recreational vehicle light fixture apparatus comprising:

a horizontally disposed hollow, channel-shaped frame configured with an interior vertical wall defining a panel-receiving opening leading upwardly into a panel-receiving pathway;

the frame including a plurality of frame segments which are each formed with a pair of laterally projecting vertical reinforcing webs defining reinforcing boxes and respective stop pads projecting horizontally inwardly from the respective reinforcing boxes, the stop pads being configured with respective lower surfaces collectively disposed in a first horizontal plane and with respective registration pins projecting downwardly from such lower surfaces;

the frame segments intersecting to define a plurality of corners configured with vertical mounting barrels defining vertical bores for receipt of respective fastener screws;

the vertical wall being further formed with lightning holes spaced there along which are so arranged and positioned as to form, in a laterally spaced apart relationship along each frame segment, a pair of upstanding flexible legs that extend horizontally inwardly from the vertical wall at their upper extremities to define respective teeth formed with respective support surfaces collectively positioned in a second horizontal plane spaced downwardly from the first horizontal plane, the teeth further being configured with respective upwardly and inwardly sloped cam surfaces; and a fluorescent light tube mounting panel configured to be slidably received into such panel-receiving opening and pathway and to, upon upward shifting thereof in such pathway, engage the respective cam surfaces and flex the legs to shift the respective teeth outwardly to cause the panel to clear such teeth and the legs to thereafter flex to shift the teeth inwardly to dispose the respective support surfaces under the panel, the panel being further formed with a plurality of registration bores configured to be slidably received over the respective registration pins to register such panel with such frame.

* * * * *